US008097059B2

(12) United States Patent
Crafts

(10) Patent No.: US 8,097,059 B2
(45) Date of Patent: Jan. 17, 2012

(54) EXHAUSTER BYPASS SYSTEM

(75) Inventor: Douglas Whitney Crafts, Longmeadow, MA (US)

(73) Assignee: ALSTOM Technology Ltd, Baden (CH)

( * ) Notice: Subject to any disclaimer, the term of this patent is extended or adjusted under 35 U.S.C. 154(b) by 793 days.

(21) Appl. No.: 12/210,498

(22) Filed: Sep. 15, 2008

(65) Prior Publication Data

US 2010/0064953 A1 Mar. 18, 2010

(51) Int. Cl.
*B01D 51/00* (2006.01)

(52) U.S. Cl. ..... 55/467; 55/471; 55/473; 55/443; 55/461; 55/DIG. 30; 110/216; 209/134; 209/154; 209/139.1; 209/143

(58) Field of Classification Search ..... 55/467, 55/470–473, DIG. 30, DIG. 37, 443, 461; 110/216; 209/134–139.1, 154
See application file for complete search history.

(56) References Cited

U.S. PATENT DOCUMENTS

| | | | | | |
|---|---|---|---|---|---|
| 1,548,839 | A | * | 8/1925 | Henshall | 55/440 |
| 2,027,782 | A | * | 1/1936 | Lundgren | 241/61 |
| 2,041,591 | A | * | 5/1936 | Brown et al. | 209/35 |
| 3,205,843 | A | | 9/1965 | Bogot | |
| 3,240,335 | A | * | 3/1966 | Vandenhoeck | 209/136 |
| 3,397,780 | A | * | 8/1968 | Beuzeval | 209/137 |
| 3,503,502 | A | * | 3/1970 | Donelson, Jr. | 209/139.1 |
| 3,509,834 | A | * | 5/1970 | Huebler et al. | 110/191 |
| 4,242,972 | A | * | 1/1981 | Sicard | 110/234 |
| 4,253,940 | A | * | 3/1981 | Price | 209/3 |
| 4,823,712 | A | * | 4/1989 | Wormer | 110/245 |
| 4,999,037 | A | * | 3/1991 | Albritton et al. | 55/385.1 |
| 5,279,234 | A | * | 1/1994 | Bender et al. | 110/210 |
| 5,363,776 | A | | 11/1994 | Wark | |
| 5,363,778 | A | * | 11/1994 | Kmiotek et al. | 110/232 |
| 5,772,128 | A | * | 6/1998 | McRae | 241/30 |
| 5,799,592 | A | * | 9/1998 | Kmiotek et al. | 110/232 |
| 5,944,270 | A | | 8/1999 | Farris | |
| 6,202,572 | B1 | | 3/2001 | Case | |
| 6,564,727 | B1 | | 5/2003 | Kmiotek et al. | |
| 6,889,843 | B1 | * | 5/2005 | Longhurst et al. | 209/135 |
| 7,017,501 | B2 | * | 3/2006 | Mann | 110/104 R |
| 7,104,403 | B1 | * | 9/2006 | Stephens et al. | 209/20 |
| 7,278,378 | B2 | | 10/2007 | Counterman | |
| 7,585,345 | B2 | * | 9/2009 | Smasal et al. | 55/443 |
| 7,712,611 | B2 | * | 5/2010 | Longhurst et al. | 209/143 |
| 2003/0075486 | A1 | * | 4/2003 | Sussegger et al. | 209/135 |
| 2005/0160953 | A1 | * | 7/2005 | Mann | 110/106 |
| 2008/0302280 | A1 | * | 12/2008 | Case et al. | 110/106 |

* cited by examiner

*Primary Examiner* — Jason M Greene
*Assistant Examiner* — Dung H Bui
(74) *Attorney, Agent, or Firm* — Lawrence P. Zale

(57) ABSTRACT

An exhauster bypass system 20 receives an input flow of gases and entrained fine solid particles 15 from a pulverizer 12 and separates the input flow into a particle-deficient gas flow and a particle-laden gas flow. The particle-deficient gas flow is provided to a fan of an exhauster assembly through a central outlet, while the particle-laden gas flow is provided to the exhauster assembly away from the fan through a bypass outlet. The bypass system includes a housing that provides a chamber for separating the particles from the hot gases to produce the particle-laden gas flow and a particle-deficient gas flow. The bypass system further includes a plurality of vertically stacked louvers disposed before the central outlet for separating the particles from the input gas flow. The outlet may include a seal or bypass fan in fluid communication with the bypass outlet to provide the particle-laden gas flow to the exhauster assembly.

19 Claims, 5 Drawing Sheets

EXHAUSTER BYPASS SYSTEM

TECHNICAL FIELD

The present disclosure relates generally to an exhauster of a pulverizing system, and more particularly, to a bypass system for an exhauster of a pulverizing system.

BACKGROUND

This invention relates to solid fuel pulverizing and firing systems for fossil fuel furnaces of the type, wherein the fossil fuel furnace and a substantial portion of the solid fuel pulverizing and firing system by means of which solid fuel and air is supplied to the fossil fuel furnace, are operated at a predetermined pressure, and more specifically, to an exhauster employable in such solid fuel pulverizing and firing systems for fossil fuel furnaces having an improved fan assembly.

Three basic types of solid fuel pulverizer firing systems find common use. These are the direct-fired system, the semi-direct fired system, and the bin storage system. The simplest and most commonly used of these three systems, and the one to which the present invention is directed, is the direct-fired system in which solid fuel, e.g., coal, is fed in a suitable manner along with hot gases to a pulverizer. The solid fuel is simultaneously ground and dried within the pulverizer as the gases sweep through the pulverizer. The gases are cooled and humidified by means of the evaporation of the moisture contained in the solid fuel. Often, an exhauster is employed for purposes of removing the hot gases and the entrained fine solid fuel particles, i.e., the solid fuel that has been ground within the pulverizer, from the pulverizer. Moreover, this exhauster, when so employed, is located on the discharge side of the pulverizer and is operative to effect the delivery of the mixture of hot gases and entrained fine solid fuel particles to a fossil fuel furnace. The main advantages of the direct-fired system are simplicity, low cost and maximum safety. To this end, the fine solid particles, which can be subject to spontaneous combustion and thus are considered to be potentially hazardous, go directly to the fossil fuel furnace at high velocities, and thus are not given the opportunity to collect and possibly ignite spontaneously. Accordingly, the direct-fired system can be operated at the maximum temperatures that safety will permit.

One prior art form of such a direct-fired solid fuel pulverizer firing system is depicted in U.S. Pat. No. 3,205,843 entitled "Pulverized Coal Firing System" which is incorporated herewithin by reference in which it is disclosed that solid fuel passes through the inlet chute of the pulverizer onto a rotating bowl thereof. The solid fuel is pulverized by the grinding rollers of the pulverizer, which are mounted within the pulverizer housing to provide a grinding action between the grinding rollers and a grinding ring provided on the rotating bowl of the pulverizer. Air passes up through the pulverizer between the housing thereof and the rim of the rotating bowl whereby pulverized solid fuel is entrained in this air with the air-pulverized solid fuel mixture passing up into a classifier. The classifier separates the coarse solid fuel fractions and returns these fractions to the rotating bowl of the pulverizer for regrinding, while the fines retained in the air stream pass through the outlet of the pulverizer. From this outlet of the pulverizer, the air-pulverized solid fuel mixture is conveyed to the inlet of the exhauster via a conduit. The air-pulverized solid fuel mixture in turn is conveyed from the exhauster to a fossil fuel furnace through ducts.

Another prior art form of an exhauster for a solid fuel pulverizer firing system is depicted in U.S. Pat. No. 5,363,776 to Wark entitled "Exhauster Inlet Venturi" which is incorporated herewithin by reference. The Wark '776 patent discloses a known pulverizer exhauster fan assembly having a fan with a plurality of radial fan blades connected to a drive shaft by a spider assembly. The drive shaft ends in a hub, which is capped by a radial diverter cap.

Although solid fuel pulverizer firing systems constructed in accordance with the teachings of the two referenced issued U.S. patents have been demonstrated to be operative for the purpose for which they have been designed, presently large efficiency losses occur when pulverized coal enters a furnace by passing though the center of an exhauster fan. Furthermore, the impact between the paddles of the fan and the coal particles wears away at the fan components. Therefore, a need exists for a device or system capable of improving the efficiency of the exhauster assembly and reduces the wear and maintenance of the exhauster assembly.

According to an aspect illustrated herein, an exhauster bypass system includes a housing having an inlet for receiving an input flow including a gas and particle mixture. The housing further includes a central outlet for providing a central output flow including a particle deficient gas stream to an exhauster, and a bypass outlet for providing a bypass flow including a particle-laden gas stream to the exhauster. A louver separates at least a portion of the particles of the input flow from the central flow to the bypass flow. The central flow is provided to a fan of the exhauster and the bypass flow is provided to the exhauster away from the fan.

According to another aspect illustrated herein, a method of providing a central flow and a bypass flow to an exhauster assembly includes separating at least a portion of an input flow including a gas and particle mixture into a central output flow including a particle deficient gas stream, and a bypass flow including a particle-laden gas stream. The central flow is provided to a fan of the exhauster assembly. The bypass flow is provided to the exhauster assembly away from the fan.

According to another aspect illustrated herein, an exhauster bypass system includes means for receiving an input flow including a gas and particle mixture, and means for separating at least a portion of the particles of the input flow from a central flow, wherein the separated particles are provide to a bypass flow. The exhauster bypass system further includes means for providing the central output flow including a particle deficient gas stream to a fan of an exhauster, and means for providing a bypass flow including a particle-laden gas stream to the exhauster away from the fan.

SUMMARY

The above described and other features are exemplified by the following figures and detailed description.

BRIEF DESCRIPTION OF THE DRAWINGS

Referring now to the Figures, which are exemplary embodiments, and wherein the like elements are numbered alike.

DETAILED DESCRIPTION

Figure 1:
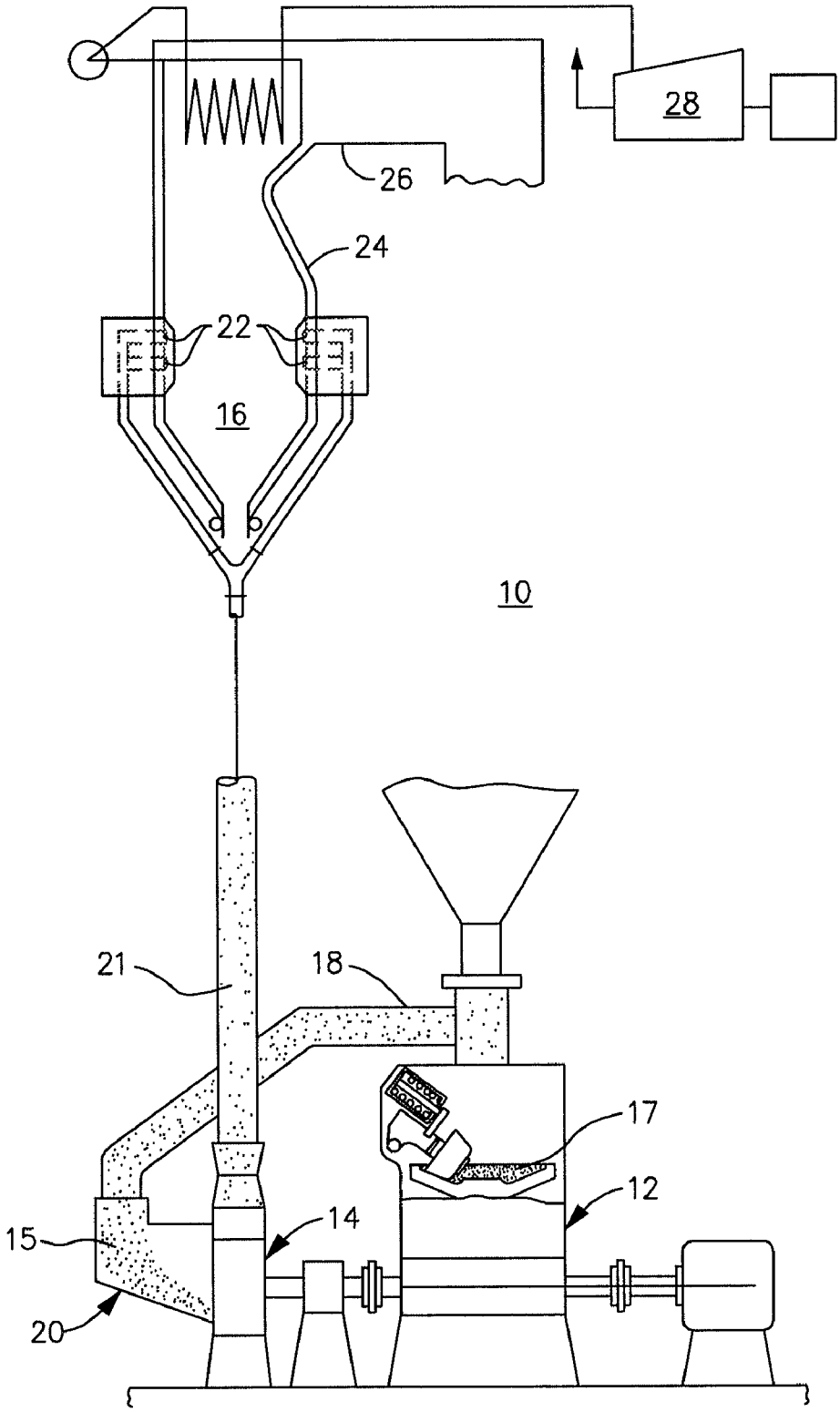
FIG. 1 is a schematic view of a pulverized combustion system in accordance with the present invention.

Referring now to FIG. 1, a solid fuel combustion system 10 embodying the present invention is depicted, which is exemplary of a configuration for a new utility unit or a configuration for retrofitting an existing utility unit. The solid fuel combustion system includes a solid fuel pulverizer 12 and an exhauster assembly 14, both of which deliver a mixture of a gas or air and entrained fine solid fuel particles 15 from the pulverizer 12 to a furnace 16. Specifically, the pulverizer grinds solid fuel 17, such as coal, to the fine particles 15, which is drawn up through the pulverizer and out through a duct 18 to an exhauster bypass system 20. As will be described in greater detail, the bypass system 20 separates a portion of the entrained particles from the air such that the air is feed directly into a fan of the exhauster assembly 14, while the separated portion of particles are indirectly fed to the exhauster assembly away from the fan, which will be described in greater detail hereinafter. The exhauster assembly 14 then directly blows the pulverized fuel 15 to the furnace 16 via duct 21.

The furnace 16 operates in a conventional manner to combust the pulverized solid fuel 15 and air fed thereto. To this end, the pulverized solid fuel and air is injected into the furnace 16 through a plurality of burners 22. Additionally, secondary air, which may be needed to combust the pulverized solid fuel 15 within the furnace 16, is injected into the furnace through the burners 22. Hot gases produced from the combustion of the pulverized solid fuel 15 and air rise upwardly in the furnace 16. During upward movement the hot gases in the furnace 16, the gases give up heat to a fluid passing through tubes 24 that, in conventional fashion, line all four of the walls of the furnace 16. The hot gases then exit the furnace 16 through a horizontal pass 26, which in turn leads to a rear gas pass. Both gas passes commonly comprise other heat exchanger surfaces (not shown) for generating and superheating steam, in a manner well-known to those skilled in this art. Thereafter, the steam flows to a turbine 28, which in turn is connected to a variable load, such as an electric generator (not shown) such that electricity is produced from the generator.

Referring the FIG. 1, the operation of the solid fuel pulverizer 12 and exhauster assembly will be described. Solid fuel 17 is supplied to and is pulverized within the pulverizer 12. In turn, the pulverizer 12 is connected by means of a duct 18 to the exhauster assembly 14 whereby the pulverized solid fuel 15 entrained in an air stream passes from the pulverizer 12 through the duct 18 to the exhauster bypass system 20. The bypass system separates the particles from the airflow and provides the airflow to the exhauster assembly 14, which blows the particles to the burners 22 via duct 21.

Figure 2:
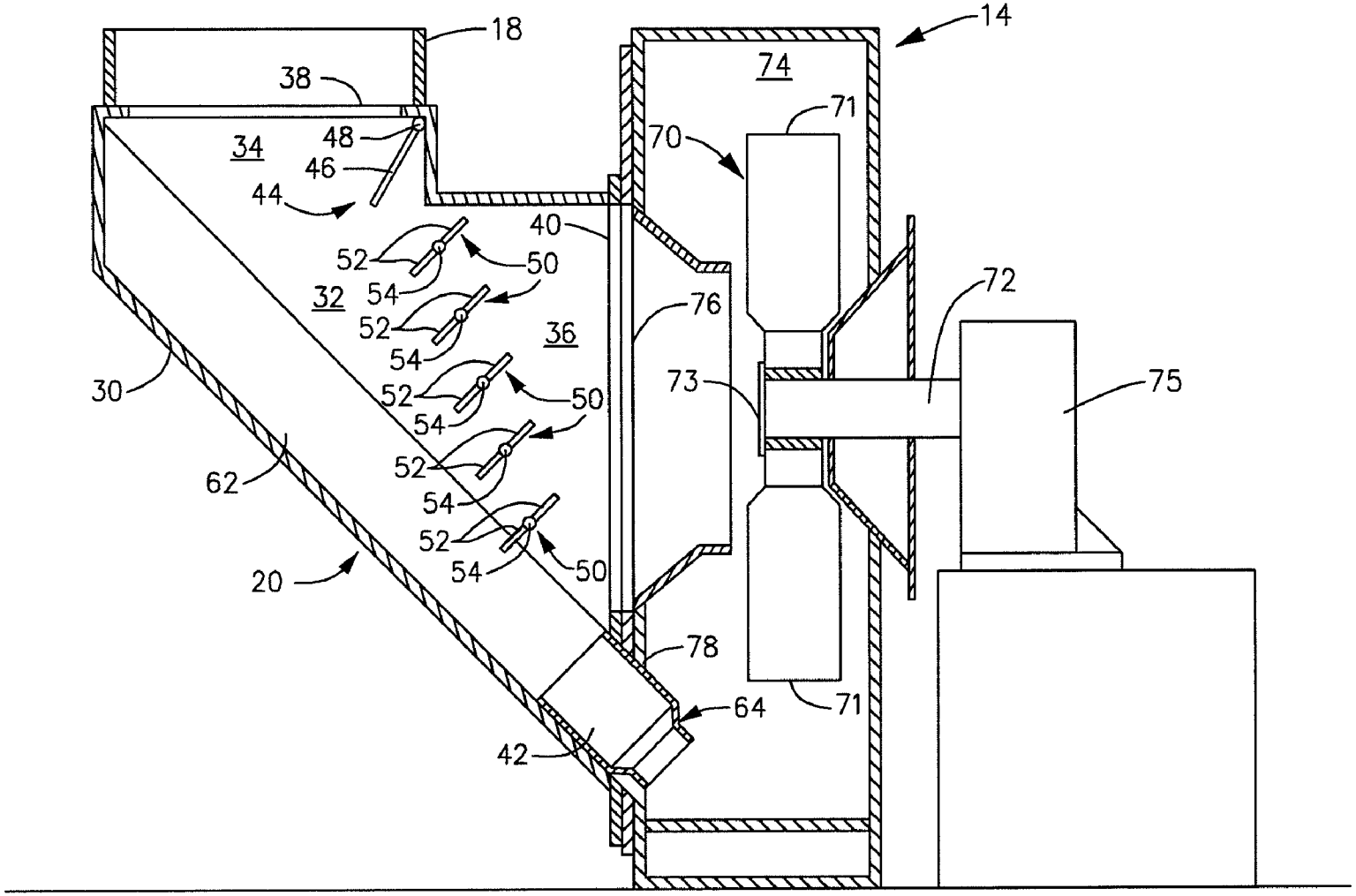
FIG. 2 is a cross-sectional side view of an exhauster assembly and an exhaust bypass system in accordance with the present invention.

A more detailed description of the exhauster bypass system 20 and exhauster assembly 14 now follows with reference to FIG. 2, which is an enlarged side elevational sectional view of both the bypass system 20 and exhauster assembly 14. The bypass system includes a housing 30 that provides a chamber 32 having a vertical input portion 34 and a horizontal output portion 36. The vertical portion 34 of the chamber 32 has an upper inlet 38 in communication with the duct 18 for receiving the particle entrained air stream 15 from the pulverizer 12. The horizontal output portion 36 includes an upper central outlet 40 and a lower bypass outlet 42 in fluid communication with the exhauster assembly 14. The central outlet provides a particle-reduced air stream to the exhauster assembly 14, while the bypass outlet 42 provides a particle-laden air stream.

An inlet louver 44 is provided in the vertical portion 34 of the chamber 32 adjacent the inlet 38 for directing the forward portion of the input air stream back away from the horizontal portion 36 of the chamber. The inlet louver 44 extends the width of the vertical chamber 34. The inlet louver 44 comprises a fin 46 attached to a horizontal rod 48. The inlet louver may be fixed or adjustable to a desired angle.

Figure 3:
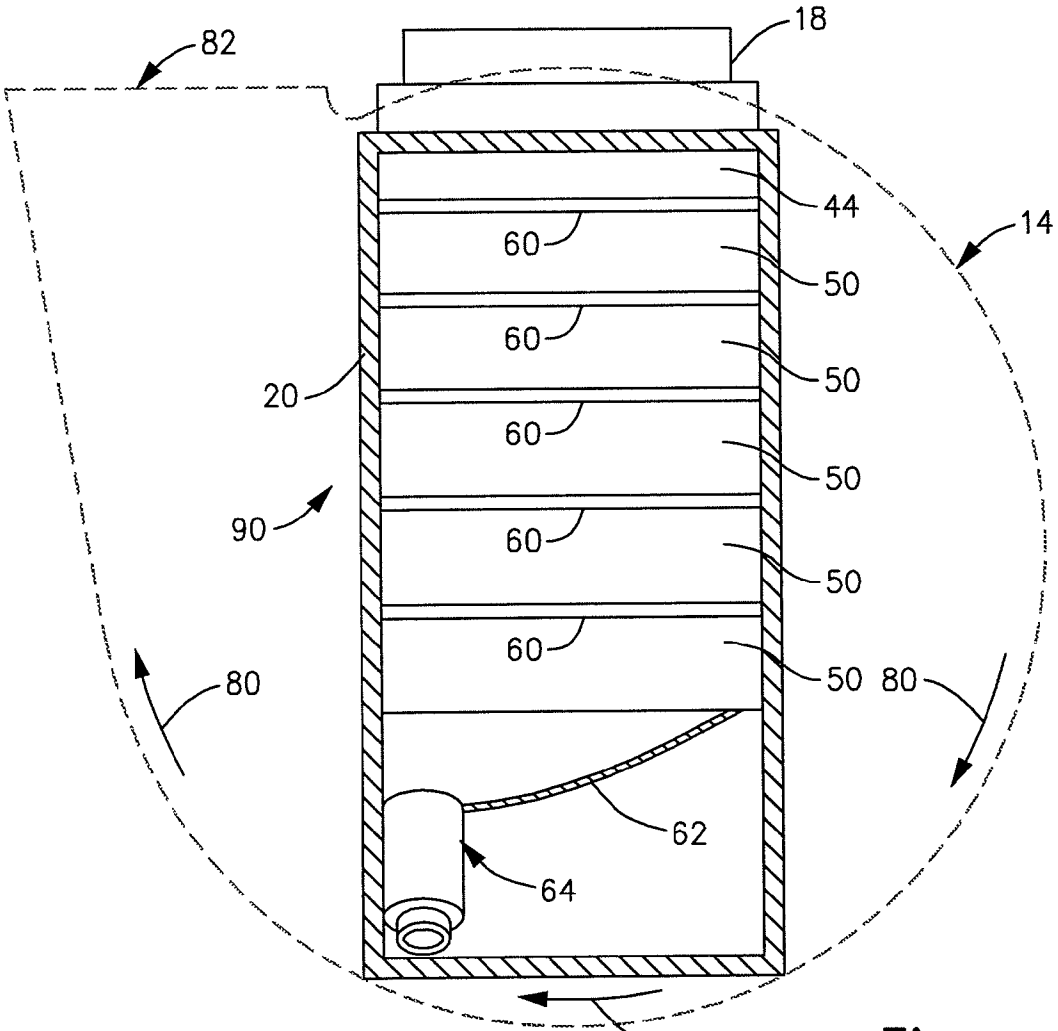
FIG. 3 is a cross-sectional front view of the exhauster bypass system of FIG. 1 wherein the outer profile of the exhaust assembly is shown in phantom.

The bypass system 20 further includes a plurality of output louvers 50 stacked vertically within in the horizontal portion 36 of the bypass housing 30. Each louver 50 extends horizontally across the width of the chamber 32, as best shown in FIG. 3, and is disposed at a defined angle. Each louver includes a pair of planar fins 52 disposed opposingly on a respective central rod 54 extending the length of the louvers. The angle of each louver is approximately the same angle, whereby the louvers are sloped upwardly. The louvers 50 may be fixed or adjustable to a desired angle. The location of each louver 50 within the chamber 32 steps forward towards the outlets 40,42 of the housing 30, whereby the lowermost louver is closer to the outputs than the uppermost louver. The output louvers 50 are stacked such that each louver overlaps the louver disposed thereabove. Further, the stacked louvers are positioned before the upper outlet 40 to provide air resistance and interference of the input air stream to the upper outlet. As best shown in FIG. 3, the louvers 50 are spaced to provide minimal spacing 60 therebetween. The air currents created by the louvers 50 and the contact of the coal particles against the louvers force and/or direct the particles downward towards the bottom 62 of the bypass chamber 32 of the bypass system 14. Gravity will be the primary moving force of the concentrated coal. The bottom 62 of the chamber includes a sloped surface that slopes in two planes downwardly and to one side of the bypass system towards the lower bypass outlet 42. The bypass outlet 42 may include a seal 64 that permits the particle-laden air stream to the exhauster but prevents or limits back pressure or flow from the exhauster assembly 14 back into the bypass system 20. Any air that blows back from the exhauster fan 70 to the bypass system 20 will not only lower fan efficiency, but also carry coal intended for bypass back into the central inlet 76. This seal could be accomplished with a rotary seal, an aspirated air seal, or steam injector, as is known in the art.

Referring FIG. 2, the exhauster assembly 14 includes a fan 70 mounted on a shaft 72 for rotation of the fan about a shaft rotational axis. The fan is driven by a motor 75. The exhauster fan 70 includes a plurality of blades 71 and a hub 73. The blades 71 are mounted to the hub 44 at uniform angular spacings therearound and project radially outwardly therefrom.

The fan 70 rotates within a housing 74, which has an upper central inlet 76 and a lower inlet 78 that communicate with the bypass system 20 via the upper central outlet 40 and lower bypass outlet 42, respectively. The central inlet 76 of the exhauster assembly 14 is generally aligned with the shaft rotational axis such that air stream entering the housing 74 through the central inlet 76 contacts the rotating exhauster fan 70 and is redirected thereby along a radial outlet path, denoted by the arrows 80 as best shown in FIG. 3. The lower inlet 78 of the exhauster assembly 14 is disposed at the bottom of the housing 74 below the outlet 82 of the exhauster assembly 14, such that the particle-laden air does not contact the rotating blades 71 of the exhauster assembly 14. The radial airflow 80 created by the fan 70 then carries the particle-laden flow directly to the outlet 82 without contacting the fan blades.

Figure 4:
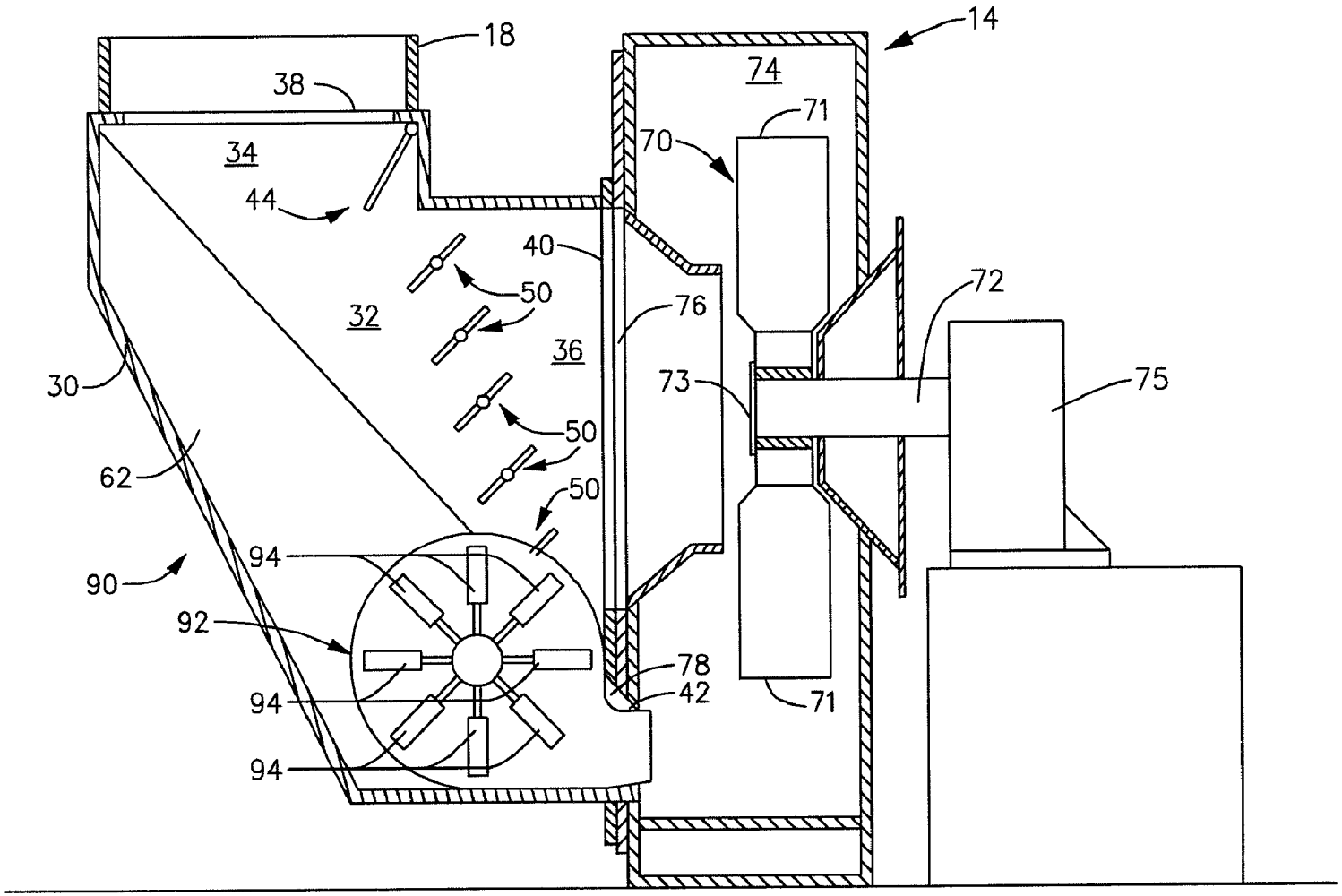
FIG. 4 is a cross-sectional side view of an exhauster assembly and an another embodiment of an exhaust bypass system in accordance with the present invention.
Figure 5:
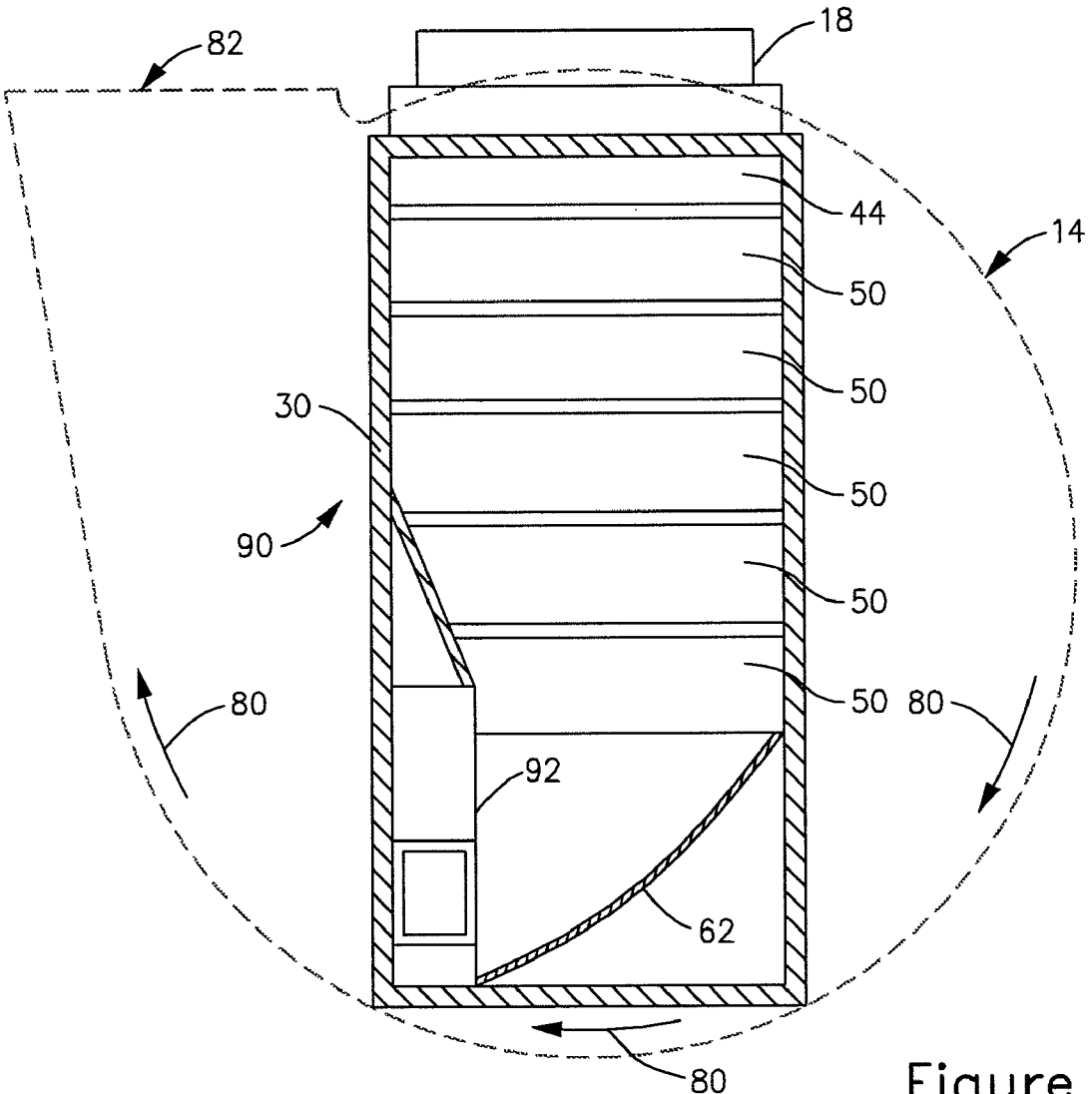
FIG. 5 is a cross-sectional front view of the exhauster bypass system of FIG. 4 wherein the outer profile of the exhaust assembly is shown in phantom.

Referring to FIGS. 4 and 5, another embodiment of an exhauster bypass system 90 is provided which is similar to that shown in FIGS. 2 and 3, wherein like components have the same reference numeral. The bypass system 90 of FIGS. 4 and 5 substitutes the seal 64 with a bypass fan 92 that blows the particle-laden air stream into the lower bypass opening 42 of the bypass system 90 and the exhauster assembly 14. The bypass fan may be a relatively small high speed fan, which is highly protected against wear. The bypass fan would have flat open paddles 94, which are best suited for high wear applications such as the exhauster fan 70. The bypass fan 92 is tilted or position such that the particles blown into the exhauster assembly 14 bypasses the fan 70 and flows direct through the outlet 82 of the exhauster assembly.

As noted, the removal of the large majority of the coal from the air stream entering the existing bypass fan 90 would greatly reduce maintenance costs of the larger exhauster fan 70. Additional benefits of the bypass fan include added power and air flow from the bypass fan could supplement the larger, exhauster fan. The removal of liners in the exhauster fan allows a more efficient and complex exhauster fan 70 to be economically used. Further, a larger central inlet 76 will allow a larger fan 70, which will improve flow of the exhauster fan.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An exhauster bypass system comprising:

a housing having an inlet for receiving an input flow including a gas and particle mixture, a central outlet for providing a central output flow including a particle deficient gas stream to an exhauster, and a bypass outlet for providing a bypass flow including a particle-laden gas stream to the exhauster;

a louver that separates at least a portion of the particles of the input flow from the central flow, wherein the separated particles are provide to the bypass flow; and wherein the central flow is provided to a fan of the exhauster and the bypass flow is provided away from the fan.

2. The exhauster bypass system of claim 1, wherein the louver is pitched upwardly a desired angle.

3. The exhauster bypass system of claim 1, wherein the louver includes a plurality of vertically stacked louvers.

4. The exhauster bypass system of claim 3, wherein the vertically stacked louvers are disposed before the central outlet.

5. The exhauster bypass system of claim 3, wherein the vertically stacked louvers partially overlap with adjacent louvers.

6. The exhauster bypass system of claim 3, wherein the vertically stacked louvers are disposed in an outwardly stepped configuration.

7. The exhauster bypass system of claim 1, further includes an input louver disposed adjacent the inlet to direct a portion of the input flow back away from the central and bypass outlets.

8. The exhauster bypass system of claim 1, wherein the housing includes a bottom slope to direct the separated particle towards the bypass outlet.

9. The exhauster bypass system of claim 1, further includes a seal in fluid communication with the bypass outlet to minimize back pressure from the exhauster.

10. The exhauster bypass system of claim 1, further includes a bypass fan that blows the separated particle through the bypass outlet.

11. The exhauster bypass system of claim 3, wherein the vertically stacked louvers are spaced to provide an opening between at least a pair of louvers.

12. A method of providing a central flow and a bypass flow to an exhauster assembly; the method comprising:

separating at least a portion of an input flow including a gas and particle mixture into a central output flow including a particle deficient gas stream, and a bypass flow including a particle-laden gas stream;

providing the central flow to a fan of the exhauster assembly; and providing the bypass flow to the exhauster assembly away from the fan.

13. The method of claim 12, wherein the separating further includes providing a louver for separating a portion of the particles from the input flow.

14. The method of claim 13, wherein the louver includes a plurality of vertically stacked louvers.

15. The method of claim 13, wherein the vertically stacked louvers are disposed in an outwardly stepped configuration.

16. The method of claim 12, further includes directing a portion of the input flow away from the central and bypass outlets.

17. The method of claim 12, wherein the separate particles are directed towards the bypass outlet.

18. The method of claim 12, further includes providing a seal in fluid communication with the bypass outlet to minimize back pressure from the exhauster.

19. The method of claim 12, further includes blowing the separated particles through the bypass outlet.

* * * * *